US008524633B2

(12) United States Patent
Masuda

(10) Patent No.: US 8,524,633 B2
(45) Date of Patent: Sep. 3, 2013

(54) SECURITY FEATURE FOR RECORDING MATERIALS

(75) Inventor: Takao Masuda, Takasago (JP)

(73) Assignee: Mitsubishi HiTec Paper Europe GmbH, Flensburg (DE)

( * ) Notice: Subject to any disclaimer, the term of this patent is extended or adjusted under 35 U.S.C. 154(b) by 1150 days.

(21) Appl. No.: 11/791,622

(22) PCT Filed: Jun. 22, 2005

(86) PCT No.: PCT/EP2005/006746

§ 371 (c)(1),
(2), (4) Date: May 25, 2007

(87) PCT Pub. No.: WO2006/136188

PCT Pub. Date: Dec. 28, 2006

(65) Prior Publication Data

US 2008/0157517 A1 Jul. 3, 2008

(51) Int. Cl.
*B41M 5/26* (2006.01)

(52) U.S. Cl.
USPC ..... 503/206; 428/29; 428/199; 428/206; 428/313.3; 428/314.2; 428/916; 283/92

(58) Field of Classification Search
USPC ..... 428/29, 313.3, 313.5, 314.2, 199, 428/206, 916; 503/206; 283/92; 162/140
See application file for complete search history.

(56) References Cited

U.S. PATENT DOCUMENTS 4,089,995 A * 5/1978 Ferro et al. ..... 427/157
4,720,450 A * 1/1988 Ellis ..... 430/339
4,916,111 A * 4/1990 Yaguchi et al. ..... 503/226
5,275,870 A 1/1994 Halope et al.
5,589,434 A * 12/1996 Takahara et al. ..... 503/227
6,054,021 A * 4/2000 Kurrle et al. ..... 162/140
6,244,508 B1 6/2001 Straub
6,245,711 B1 * 6/2001 Halbrook, Jr. ..... 503/206
6,383,618 B1 5/2002 Kaule et al.
6,444,377 B1 9/2002 Jotcham et al.

FOREIGN PATENT DOCUMENTS

| | | |
|---|---|---|
| DE | 198 54 866 | 8/1999 |
| EP | 0 844 097 | 5/1998 |
| EP | 0 854 451 | 7/1998 |

(Continued)

OTHER PUBLICATIONS

Machine translation of detailed description of JP 10-217608 A. Created on Jun. 18, 2010.*

(Continued)

*Primary Examiner* — Gerard Higgins
(74) *Attorney, Agent, or Firm* — Cozen O'Connor

(57) ABSTRACT

The invention relates to a novel security feature in the form of a luminescent marking for integration in a recording material. The security feature comprises a radiation layer (21) with luminescent components and a masking layer (2) with cavity pigments at least partly masking the radiation layer. The pigments in the masking layer (2) are fused by locally defined heal treatment into the form of a marking. The invention particularly relates to a heat-sensitive recording material comprising, in a preferred embodiment, at least one substrate (10), a heat-sensitive recording layer (30), an intermediate layer (21), between the substrate and the heat-sensitive recording layer in the form of a radiation layer with luminescent components and a masking layer with cavity pigments (2), the pigments of the masking layer (2) being fused in the form of a marking by locally defined fusion.

18 Claims, 2 Drawing Sheets

(56) References Cited

FOREIGN PATENT DOCUMENTS

| | | | |
|---|---|---|---|
| EP | 1 016 548 | | 7/2000 |
| JP | 10217608 A | * | 8/1998 |
| WO | WO 99/38703 | | 8/1999 |

OTHER PUBLICATIONS

Search Report dated Jul. 3, 2006 issued for the corresponding International Application No. PCT/EP2005/006746.

* cited by examiner

SECURITY FEATURE FOR RECORDING MATERIALS

CROSS REFERENCE TO RELATED APPLICATIONS

This is a U.S. national stage of International Application No. PCT/EP2005/006746, filed on 22 Jun. 2005.

BACKGROUND OF THE INVENTION

1. Field of the Invention

The invention pertains to a security feature in the form of a luminescent mark for incorporation into recording material and to heat-sensitive recording material into which the security feature of the proposed type has been incorporated.

2. Description of the Related Art

Recording materials are in an integral part of daily life in society and in the business world. Various solutions for proof-of-authenticity security features have already been proposed in the past for the use of recording materials which must be shown to be authorized for the purpose in question by a specific mark incorporated into the approved stock.

The authenticity of a document can be established passively by inspecting it for the presence of a watermark, for example. In its original meaning, a watermark is understood to be a mark in the paper, which is formed by differences in the thickness of the paper. A distinction is made between genuine watermarks, which are produced by displacing the pulp fibers (so-called line watermarks) or by concentrating the pulp fibers (so-called shadow watermarks) by the use of, for example, a dandy roll in the wire section of the papermaking machine; semi-genuine, so-called "molette" watermarks, which are produced by impressing a mark into the still-wet paper in the pressing section of the paper machine; and finally inauthentic or "pseudo" watermarks, which are usually produced outside the paper machine either by embossing or by printing the finished paper with a colorless lacquer, preferably one which is fluorescent under UV light. In the last-mentioned example of a "pseudo" watermark, of course, the addition of the mark to the paper produces no difference in the thickness of the paper.

In the prior art to be discussed here, DE 690 01 677 T2, for example, proposes the use of a synthetic printing carrier with pseudo-watermarks. The carrier consists of a substrate of plastic, at least one authentication or security symbol, preferably applied by gravure printing to change the opacity of the printing carrier, and at least one printable pigment coating, which covers the mark. The monochrome or polychrome mark should be almost invisible in reflected light but readily visible in transmitted light. The disadvantage of the known printing carrier is that the pseudo-watermark printed on it can be counterfeited relatively easily, which cannot be prevented by applying simple pigment coatings on top of it.

In principle, heat-sensitive recording materials with proof-of-authenticity security features in the form of inauthentic and fluorescent watermarks are also known. EP 0 844 097 A1, for example, discloses a latent image printed on the reverse of the recording material as a security feature for a heat-sensitive recording material. This image is produced by means of a security ink containing a fluorescent reagent. To form a second security feature in the form of a waterproof image on the reverse of the heat-sensitive recording material, the security ink contains a water-repelling agent. The security ink formulated in this way with the fluorescent reagent in the form of pigment or dye and with the water-repelling agent is contained or dispersed in an aqueous carrier, which, in addition to these components, can also contain a binder. The disadvantage of this proposal is that the water-repelling character of the security ink makes it more difficult to use the standard printing methods to preprint the carrier with multiple images and lettering, as is conventionally done.

Another fundamental disadvantage of the conventional pseudo-watermarks known from the state of the art—a disadvantage which also applies to the document discussed above—is to be found in the fact that they are applied afterwards to the finished paper by embossing or single-layer printing, for which reason it is relatively easy to counterfeit them.

SUMMARY OF THE INVENTION

Against the background of the prior art described above, the task of the invention is to create a security feature for incorporation into recording material, namely, a feature which is suitable for almost any conceivable application and which is as difficult as possible to counterfeit. Another task consists in making available especially a heat-sensitive recording material with a new security feature which is suitable for almost any conceivable application and which is as difficult as possible to counterfeit.

The inventor recognized initially in general that the previously described prior art can be summarized basically by saying that, the more closely the point at which a security feature is created during the production and processing chain is moved to the original production point the more difficult it will be to simulate the security feature with the intention of creating a counterfeit. Against this background, a security feature which has ideally been subjected to a post-treatment or been provided with additional coatings fulfills to a very special degree the requirements imposed on such a security feature, namely, the requirement that it be all but impossible to forge or to copy the feature with the intention of counterfeiting it.

Specifically, the inventor recognized that the task can be accomplished by a security feature in the form of a luminescent mark for incorporation into recording material, where the security feature has an emission layer with luminescent components and a masking layer with hollow pigment particles at least partially covering the emission layer, and where the hollow pigment particles of the masking layer are fused or can be fused in the form of a mark by a locally defined heat treatment.

"Luminescent components" in all of the proposed embodiments and variants of the invention are, for example, pigments or dyes such as optical brighteners and particles such as fibers treated with such pigments or dyes which are added to the emission layer and can be excited by the absorption of energy to emit light. To a special degree, the luminescent components are to be understood as those which, by stimulation with UV light, can be excited to emit visible light over a period ranging from fractions of a second to more than half an hour. Such components are referred to in accordance with the invention as "fluorescent" and are considered especially preferred.

The hollow pigment particles of the masking layer have a shell of plastic, ideally of thermoplastic resin, which melts when intense heat is supplied. This thermoplastic resin or the external wall of the hollow pigment particle itself preferably contains (meth)acrylic copolymer, polyvinyl chloride, polyvinylidene chloride, polystyrene, styrene acrylate, styrene (meth)acrylate copolymer, polyacrylonitrile, polyacrylic acid ester, or a mixture of at least two of the prepolymer components. Pigment mixtures of different hollow pigment particles can also be used for the masking layer. In accordance with the present invention, so-called "cup-shaped" pigments are also considered hollow pigment particles. In contrast to the standard hollow pigment particles, in which an inner core of gas, usually air, is completely enclosed by a shell of organic, usually thermoplastic components, the "cup-shaped" pigments do not have a completely closed shell, the inner core being surrounded only by a cup-like shape, which should be closed as far as possible.

It has been found advantageous for the thermoplastic resin forming the external wall of the hollow pigment particles to have a glass transition temperature in the range from 35° C. to less than or equal to 200° C., and preferably in the range from 75° C. to less than or equal to 120° C., because, at temperatures below 35° C., the shell of the hollow pigment particles is no longer sufficiently stable at room temperature, whereas, at temperatures above 200° C., handling problems associated with the excessive heating of the surface of the recording material are encountered. The preferred temperature range between 75° C. and less than or equal to 120° C. supplies the simplest conditions with respect to processing quality and speed during the production of the proposed security feature by melting the hollow pigment particles in the form of a pattern.

To form the inventive security feature, its emission layer with the luminescent components or preferably with the components which are fluorescent under UV light is first covered opaquely by the masking layer of hollow pigment particles. Because the hollow pigment particles make the masking layer opaque, no luminescence or fluorescence can be seen at all from the emission layer. By means of the local, preferably sharply delineated, input of heat in the form of any desired pattern, the hollow pigment particles of the masking layer can be fused by the use of, for example, the printhead of a thermal printer. In the heat-treated areas of the masking layer, the hollow pigment particles are then no longer in the form of individual particles, consisting of a thermoplastic shell and a core of air inside the shell, but are rather now in the form of a uniform, milky-translucent fused layer, which has thus lost its opacity. The loss of opacity is explained by the difference between the coefficient of refraction of the plastic shells of the hollow pigment particles and the coefficient of refraction of the air in the interior of the unfused hollow pigment particles. In cases where the masking layer is not covered by at least one additional white layer or by a colored layer, the emission layer and the masking layer of the proposed security feature should be of the same color, because the heat-treated areas of the masking layer become transparent and allow the emission layer underneath it to be readily seen. White is an especially good color for the emission layer and for the masking layer of the proposed security feature. The reason for this is that, because the hollow pigment particles are white when in the unfused state, the masking layer is white in any case unless additional pigments are added to it. The emission layer and the masking layer of the proposed security feature, however, can also have a light coloration, which is therefore considered another possible form of the proposed security feature and can be used without limitation.

An important advantage of the inventive security feature in the form of an individual pattern is that it can be produced by the use of, for example, a thermal printer after the production of the recording material provided with the two layers of the proposed security feature. Thus, recording material with a proof-of-authenticity security feature can be proposed to the public which can be produced in a highly economical manner without the need for individualized tools. In addition, the security feature is virtually impossible to counterfeit, because, by the use of serial numbers, for example, a different security feature can be created for each individual copy.

DETAILED DESCRIPTION OF THE PRESENTLY PREFERRED EMBODIMENTS

Figure 1:
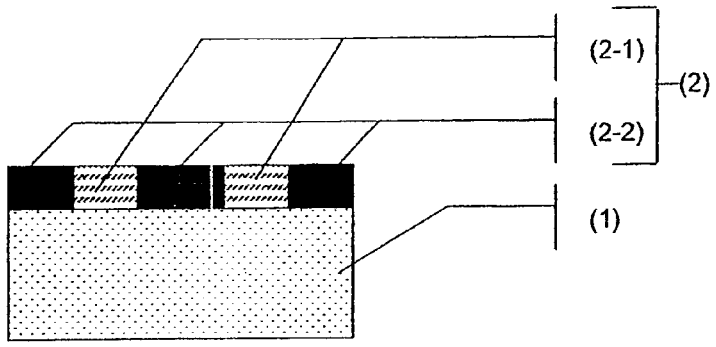
FIG. 1 shows the inventive security feature with an emission layer and a two part masking layer.

FIG. 1 shows the basic structure of the inventive security feature with an emission layer (1) and a masking layer (2) covering the emission layer (1). In the figure, the areas (2-1) of the masking layer (2), in which the hollow pigment particles have been fused by a heat treatment and for which reason the masking layer (2) has become milky-translucent in these areas (2-1), are shown cross-hatched, whereas the areas (2-2) of the masking layer (2) with unfused hollow pigment particles are shown uniformly black—characterizing an opaque covering. In the following figures, the milky-translucent areas and the transparent areas of the masking layer (2) are not differentiated.

In a first, very simple embodiment of the invention, the recording material with the new security feature comprises a white substrate, provided with luminescent components, as the emission layer. The masking layer is applied on top of the substrate. In general, the masking layer should have a basis weight preferably in the range of 1-6 g/m$^2$, and even more preferred in the range of 2-3 g/m$^2$. In various series of experiments, it was found that, if the basis weight of the masking layer is less than 1 g/m$^2$, the coverage of the emission layer is often no longer sufficiently guaranteed, whereas forming a masking layer with a basis weight of much more than 6 g/m$^2$ is economically unreasonable. The usual percentage by weight of the hollow pigment particles in the masking layer relative to the total weight (absolute dry) of the masking layer is preferably in the range of 50-95 wt. %, the remainder consisting only of the necessary quantity of binders. The hollow pigment particles are partially fused in the form of a pattern. In the preferred case that the luminescent components are fluorescent under UV light, the recording material appears white in daylight; there is no sign at all of an incorporated security feature. When the recording material is viewed under UV light, however, the fluorescent components of the substrate become visible in the areas of the masking layer where the hollow pigment particles of the masking layer were fused by the heat treatment.

To improve the external appearance of recording material with the proposed security feature, a protective layer or a pigment coating which improves its printability—including printing by the inkjet method, if desired—can be applied to the masking layer. Although a layer of this type makes it more difficult to see the incorporated security feature, the fluorescence from the emission layer shining through the fused areas of the masking layer will nevertheless remain sufficiently visible as long as the pigment coating is white or not too darkly colored and especially if the protective layer is formulated to be colorless, which is the preferred approach.

Figure 2:
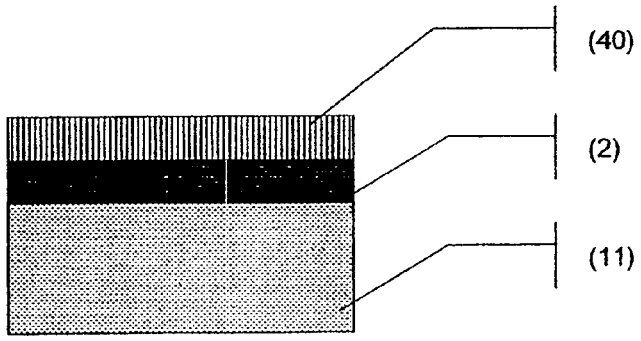
FIG. 2 shows a recording material with the inventive security feature.

FIG. 2 shows recording material with the inventive security feature. The recording material here is in the form of one of its simplest embodiments. A masking layer (2) is applied to a substrate (11) designed as an emission layer with, in the present case, fibers which are fluorescent under UV light, for example. The hollow pigment particles of the masking layer (2) are fused by the printhead of a thermal printer in the form of a pattern. The masking layer (2) completely covers the substrate (11) lying underneath. The masking layer (2) is itself covered by a protective layer (40).

If, as sometimes happens for reasons of production technology, no luminescent components or no components which are preferably fluorescent under UV light are to be incorporated into the substrate, it is advisable to provide a separate, first coating underneath the masking layer to serve as the emission layer with the luminescent/fluorescent components. The basis weight of the emission layer is preferably in a range of 5-20 g/cm$^2$. Simultaneously, the percentage by weight of luminescent/fluorescent components in the emission layer based on the total weight (absolute dry) of the emission layer is preferably in a range of 0.2-5 wt. % (absolute dry). Additional coatings, especially leveling coatings, which can be applied between the substrate and the emission layer have the ability to reduce the necessary demand for luminescent/fluorescent components to be incorporated, because, when a leveling coating is used, the basis weight of the emission layer to be applied can be very low, i.e., under certain conditions in a range of 1-5 g/m$^2$, and thus the amount of luminescent/fluorescent components in the emission layer can easily be in the range of 1-10 wt. % (absolute dry). Independently of this, a protective layer or a pigment coating which improves the printability—including by the inkjet method, if desired—can be provided on top of the masking layer.

Because of the production of the pattern-containing security feature preferably by the use of the printhead of a thermal printer, the proposed security feature is especially suitable for incorporation into heat-sensitive recording material.

According to the invention, a heat-sensitive recording material of this type comprises an emission layer with luminescent components or, in a preferred embodiment, components which are fluorescent under UV light, and a masking layer with hollow pigment particles, which at least partially covers the emission layer, where the hollow pigment particles of the masking layer are fused or can be fused in the form of a mark by a locally defined heat treatment. The emission layer with the luminescent components or preferably the components which are fluorescent under UV light and the masking layer with the hollow pigment particles of the proposed heat-sensitive recording material should preferably be of the same color.

In a first, simple embodiment, luminescent components or preferably components which are fluorescent under UV light are incorporated into the substrate serving as the emission layer of the proposed heat-sensitive recording material. A masking layer with hollow pigment particles is applied to the substrate, and the pigments are fused in the form of a mark by the locally defined heat treatment. A heat-sensitive printing layer is then applied to the masking layer. The printing layer has at least one dye precursor and at least one dye acceptor, where the dye precursor and the dye acceptor react with each other under the action of heat to form a color. In a first variant, the heat-sensitive printing layer can completely cover the entire area of the masking layer underneath. In another variant, the heat-sensitive printing layer is applied to—that is, in the present case, preferably printed onto—the masking layer only in the form of small rectangular or circular areas, for example, so-called "spots", only a few centimeters in size. Areas which are covered by the masking layer are now present next to areas which are covered by the heat-sensitive printing layer with the masking layer underneath. Whereas the areas with the heat-sensitive printing layer applied in the form of spots are especially suitable for forming individual fields, e.g., with seat numbers on entrance tickets, the remaining areas, which are not covered by the heat-sensitive printing layer but only with the masking layer, can present frame information, e.g., the name of the event and advertising on tickets, in that they are produced as desired by means of, for example, flexograpy.

Alternatively to the structure described above, the heat-sensitive printing layer can be applied first to the substrate, and this layer can be at least partially covered in turn by the subsequently applied masking layer with the hollow pigment particles. In this variant, either the substrate can function as the emission layer with the luminescent components or preferably with the components which are fluorescent under UV light, where the heat-sensitive printing layer should be as transparent as possible to allow the luminescent or fluorescent emission of the substrate to shine through with as little hindrance as possible, or the heat-sensitive printing layer contains the luminescent components or the components which are preferably fluorescent under UV light and functions as the emission layer. Of course, it is also possible for both the substrate and the heat-sensitive printing layer to contain the luminescent or UV-fluorescent components, just as it is also possible in general for all the proposed embodiments and variants of the present invention for two layers, one on top of the other, to be used as emission layers. It is also possible for the two emission layers to contain different luminescent or UV-fluorescent components, which, for example, emit light of different colors, and also for different luminescent or preferably UV-fluorescent components to be present in only one emission layer according to all the embodiments and variants of the proposed invention.

For reasons related to production, it is sometimes not possible to incorporate luminescent components into both the substrate and into the heat-sensitive printing layer. For this reason, in a preferred embodiment, the proposed heat-sensitive recording material with substrate, heat-sensitive printing layer, and masking layer, has at least one intermediate layer situated between the substrate and the heat-sensitive printing layer, this intermediate layer functioning as the emission layer. If, in a preferred embodiment, the intermediate layer is applied by coating devices with a leveling action such as roll coaters, spreading knifes, or (revolving) doctor blades, the intermediate layer can also make a positive contribution to the leveling of the surface of the substrate, as a result of which the quantity of coating material which must be applied for the heat-sensitive printing layer can be reduced. It has been found that good results are obtained when the basis weight of the intermediate layer is preferably in a range of 5-20 g/m$^2$, and even more preferably in the range of 6-10 g/m$^2$. The percentage by weight of luminescent/fluorescent components based on the total weight (absolute dry) of the intermediate layer is preferably in the range of 0.2-5% (absolute dry).

If inorganic oil-absorbing pigments are incorporated into the intermediate layer situated underneath the heat-sensitive printing layer, these pigments can absorb the waxy components of the heat-sensitive printing layer which have been liquefied by the effect of heat during the formation of the lettering and thus make it possible for the heat-induced printing operation to be carried out even more quickly and reliably, which is especially important when, according to a claimed embodiment, an energy-absorbing masking layer is applied on top of the printing layer. A layer structure is also possible in which the masking layer is applied first to the pigmented intermediate layer designed as an emission layer, and then the heat-sensitive printing layer is applied on top of that.

Inorganic pigments which have been found to give good results for the intermediate layer and which are therefore preferred include those which belong to the group which comprises natural and calcined kaolin, silicon oxide, bentonite, calcium carbonate, and aluminum oxide, and especially boehmite. Mixtures of several different inorganic pigments can also be used.

The particle size of the inorganic pigments present in the intermediate layer, expressed as the $D_{50}$ value, is preferably in the range below 2 m. Pigments with a particle size distribution of 34-40 wt. % less than 1 m and 57-63 wt. % less than 2 m have been found to be advantageous.

In addition to the inorganic pigments, the pigmented intermediate layer also contains at least one binder, preferably a binder based on a synthetic polymer, where, for example, styrene-butadiene latex gives very good results. The use of a synthetic binder with the admixture of at least one natural polymer represents and especially suitable embodiment. Within the scope of experiments, it was also established that an especially suitable embodiment is obtained at a binder-pigment ratio within the pigmented intermediate layer of 1:10 to 1:20.

To improve the environmental resistance, which is to be understood as especially the resistance to plasticizers, oils, fats, and moisture in general and to spray water in particular, the proposed heat-sensitive recording material according to all of the proposed embodiments and variants preferably has a protective layer which completely covers the recording material on the side which carries the printing layer. Depending on whether the printing layer is applied to the masking layer—possibly only as a "spot" application—or whether the masking layer is applied to the printing layer, the protective layer can be applied to the printing layer and to the masking layer.

The protective layer, which can consist of a single or multiple layers, can, in a first embodiment, be a coating applied in the standard manner in a coating machine by means of a curtain or spray coater, an air brush, a spreading knife, or a (revolving) doctor blade, where a basis weight in the range of 1.5-6 g/m$^2$, and especially in the range of 1.8-4 g/m$^2$ has proven to give good results.

To enhance the printing, the protective layer contains, first, one or more inorganic pigments, where in particular the incorporation of a highly purified alkaline-processed bentonite is advantageous. Additional pigments are in particular natural or precipitated calcium carbonate, kaolin, titanium oxide, and very especially aluminum hydroxide and silicic acids. In addition to the pigments, the protective layer also contains one or more binders, such as those selected from the list including water-insoluble, self-crosslinking acrylic polymers, polyvinyl alcohol, and polyvinyl alcohol derivatives such as in particular silanized polyvinyl alcohol, and possibly, and as a function of the selected binders, crosslinking agents also. In particular, cyclic urea, metholoiurea, polyamide-epichlorohydrin resin, ammonium zirconium carbonate, and glyoxal have been found to be effective crosslinking agents.

Alternatively to the above-described protective layer, which represents a rather conservative possibility, the proposed recording material can preferably also have a protective layer which can be crosslinked under the effect of UV rays, the protective layer being applied, as desired, either by one of the standard methods such as curtain or spray coaters, an air brush, a spreading-knife, or a revolving doctor blade. In an especially preferred embodiment, the protective layer can be printed on. After the application/printing of the protective layer, it is cured by exposure to UV rays.

In combination with the above-described embodiments and variants, an effective and especially preferred measure is to apply at least one pigmented intermediate layer with preferably UV-fluorescent components formed as an emission layer on a substrate, and then to apply a heat-sensitive printing layer onto this emission layer. A masking layer with hollow pigment particles fused to form a pattern is laid between the printing layer and the final protective layer. To promote a very sharply contoured thermal print image, which is formed by exposing the heat-sensitive printing layer to the printhead of a thermal printer, it can be advantageous to apply the masking layer first to the minimum of one intermediate layer functioning as the emission layer, and then to apply on top of that the heat-sensitive printing layer and finally the protective layer. Both embodiments are suitable to an especially high degree for making available to the public a heat-sensitive recording material with great environmental resistance and individually prepared, difficult-to-counterfit security features, for which reason it is also preferred to a very special degree. As a variant of the most recently described embodiment with a masking applied to the emission layer, the heat-sensitive printing layer is applied to this masking layer in the form of small areas—so-called "spots"—, that is, it is preferably printed onto the masking layer in the case. Then areas which are covered by the masking layer are located next to areas which are covered by the heat-sensitive printing layer with the masking layer underneath.

Figure 3:
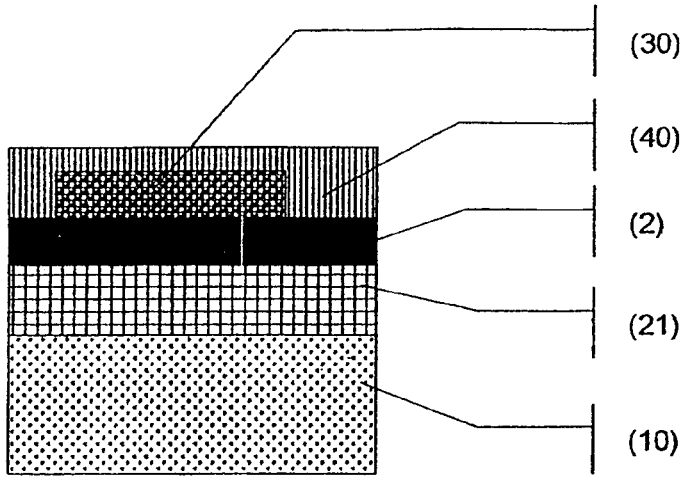
FIG. 3 shows a heat-sensitive recording material with the inventive security feature.

FIG. 3 shows an embodiment of the proposed heat-sensitive recording material with security feature, where the recording material in this case has a polyolefin-coated paper as substrate (10), onto which the intermediate layer (21), designed as an emission layer with, for example, UF-fluorescent colors, is applied. The intermediate layer (21) is completely covered by a masking layer (2), the hollow pigment particles of which are partially fused in the form of a pattern. Because a heat-sensitive printing layer (30) is to be applied to the masking layer (2), the masking layer (2) can in this case contain inorganic, oil-absorbing pigments in addition to the hollow pigment particles, these oil-absorbing pigments being able to absorb the waxy components of the heat-sensitive printing layer (30) liquefied by the action of the heat of the thermal printhead during the formation of the lettering. In this case, a ratio of hollow pigment particles to inorganic pigments in the masking layer (2) in the range of 5:1 to 2:1 has been found to be advantageous. The heat-sensitive printing layer (30) is applied here only in the form of small areas—so-called "spots"—to the masking layer (2). On the side with the heat-sensitive printing layer (30), the recording material is covered by a protective layer (40), which, because of the "spot"-like formation of the heat-sensitive printing layer (30), is applied in part to the masking layer (2) and in part to the heat-sensitive printing layer (30).

Figure 4:
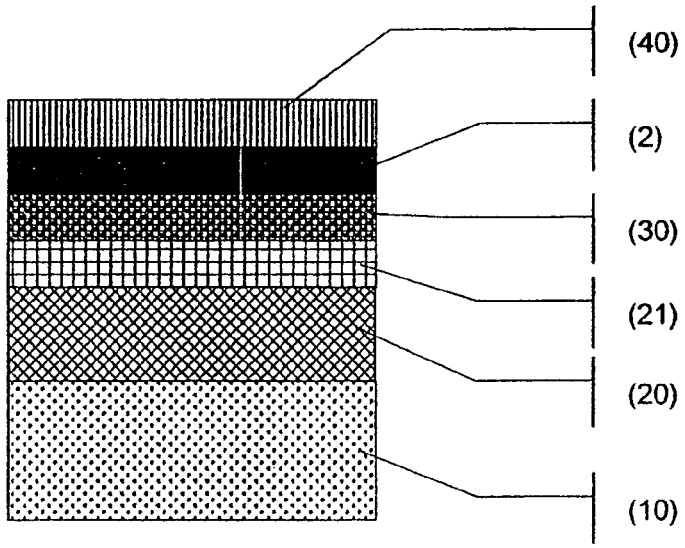
FIG. 4 shows a second embodiment of heat sensitive recording material with the inventive security feature.

FIG. 4 shows another embodiment of the proposed heat-sensitive recording material with security feature. A substrate (10), in this case a coating base paper with an untreated surface, has a first leveling intermediate layer (20) and a second intermediate layer (21), which is formed as an emission layer with UV-fluorescent pigments. Because a heat-sensitive printing layer (30) is to be applied to the second intermediate layer (21), the second intermediate layer (21) also contains, in addition to the UV-fluorescent pigments, inorganic, oil-absorbent pigments, which are able to absorb the waxy components of the heat-sensitive printing layer (30) liquefied by the effect of heat generated by the thermal printhead during the lettering process. The heat-sensitive printing layer (30), in the case shown in FIG. 4, completely covers the second intermediate layer (21). Next, a masking layer (2) with hollow pigment particles partially fused to form a pattern and then a protective layer (40) are applied on top of the heat-sensitive printing layer (30).

To fuse a portion of the hollow pigment particles in the form of a pattern, local heat is supplied to the proposed heat-sensitive recording material by means of, for example, the printhead of a thermal printer in such a way that, although the pattern-like security feature is formed in the masking layer, the lettering is not formed within the heat-sensitive printing layer at the same time. To accomplish this goal, it is necessary for the color-forming temperature of the heat-sensitive printing layer in particular to be raised to a temperature $T_2$ which is above the fusion temperature $T_1$ of the hollow pigment particles in the masking layer. Because $T_2>T_1$, it also becomes possible in one embodiment for the masking layer to be formed on top of the heat-sensitive printing layer. If an inventive heat-sensitive recording material of this type with hollow pigment particles fused in the form of a pattern in the masking layer belonging to the security feature is to be printed by a thermal printer, the printhead causes the lettering to be formed in the printing layer when the recording material is introduced into the printer, and the hollow pigment particles of the masking layer are also fused, in addition to the security feature, at the points where the lettering has been formed in the printing layer, which makes it possible to see the lettering formed in the printing layer.

To increase the color-formation temperature and/or to reduce the color-formation sensitivity, there is a possibility which is well known in the prior art and which is commonly used in industry and therefore preferred here for all embodiments and variants of the proposed heat-sensitive recording material, namely, the possibility of incorporating at least one combination of a microencapsulated dye precursor and a microencapsulated dye acceptor which react with each other to form a color under the action of heat applied to the heat-sensitive printing layer.

The use of encapsulated dye precursors and/or dye acceptors is standard practice, especially in the production of multicolor heat-sensitive recording materials Various ways and means for the production of the microcapsules containing the dye precursor and dye acceptor have been found to be especially suitable, including, for example, the interfacial polymerization method, the coacervation method, the spray-drying method, and the emulsion-evaporation-solidification method. An especially suitable method for encapsulating dye precursors and/or dye acceptors is proposed in DE 198 54 866 A1, namely, from line 5 on page 4 to line 18 on page 13, for which reason this encapsulation method is also considered as an especially preferred method in accordance with the present invention.

The formation of a protective layer which covers the heat-sensitive printing layer and which possibly consists itself of several layers and, according to a variant of the invention, the arrangement of the masking layer between the heat-sensitive printing layer and the protective layer makes it possible to increase the distance between the printing layer and the printhead of the thermal printer used to produce the printing. As the distance between the printing layer and the printhead of the thermal printer increases, the resolution necessarily becomes worse, the resolution being approximately proportional to the square of the distance between the printing layer and the thermal printhead. Against this background, it is especially important to have a heat-sensitive printing layer of the type described above with the ability to oppose this physical effect, that is, with the ability to guarantee optimized resolution. In principle, the heat-sensitive printing layer can contain any of the known dye precursors and the dye acceptors, especially organic dye acceptors, which react specifically with the precursors. Especially preferred dye precursors can be selected from the compounds in the following list, although the choice is not to be considered limited to this group:

3-diethylamino-6-methyl-7-anilinofluorane,
3-dibutylamino-6-methyl-7-anilinofluorane,
3-(N-methyl-N-propyl)amino-6-methyl-7-anilinofluorane,
3-(N-ethyl-N-isoamyl)amino-6-methyl-7-anilinofluorane,
3-(N-methyl-N-cyclohexyl)amino-6-methyl-7-anilinofluorane,
3-(N-ethyl-N-tolyl)amino-6-methyl-7-anilinofluorane, and
3-(N-ethyl-N-tetrahydrofuryl)amino-6-methyl-7-anilinofluorane, The organic dye acceptors specifically intended to react with the precursors can be selected from the group comprising:

2,2-bis(4-hydroxyphenyl) propane,
4-[(4-(1-methylethoxy)phenyl)sulfonyl]phenol,
4,4'-dihydroxydiphenylsulfone,
N-(p-toluenesulfonyl)-N'-(3-p-toluenesulfonyloxyphenyl)ureas,
2,4'-dihydroxydiphenylsulfone, and
N-(2-hydroxyphenyl)-2-[(4-hydroxyphenyl)thio]acetamide, although the dye acceptors are not to be considered limited to the list above. For the dye precursors, an average particle size in the range between greater than 0.3 m and no more than 1.5 m, and especially from 0.45 m to 0.9 m, is recommended. The limits are imposed from above by insufficient sensitivity and from below by an otherwise excessive tendency of the heat-sensitive recording material to turn gray.

As a coating device for applying the heat-sensitive printing layer, a revolving doctor blade, a spreading knife coater, a curtain coater, or an air brush is especially recommended. In correspondence with a preferred embodiment, the coating composition used to form the printing layer is aqueous. The subsequent drying of the coating composition is usually accomplished by a method in which heat is supplied, as can be done by means of hot-air float dryers or contact dryers. A combination of the previously mentioned drying methods has been found to give good results. The basis weight of the heat-sensitive printing layer is preferably in the range of 2-6 $g/m^2$, and even more preferably in the range of 2.3-5.8 $g/m^2$.

Even though the substrate is not limited to paper, paper, and here especially a coating base paper with an untreated surface, preferably with a basis weight in the range of 50-180 $g/m^2$, is used as the substrate, such as that which has become a market commodity in part because of its good environmental compatibility and recyclability. Such paper is preferred in accordance with the invention. A "coating base paper with an untreated surface" is understood to be a coating base paper which has not been sent through a size press or a coating device. Films, especially films of polyolefin, and papers coated with polyolefin can also be used as substrates in the invention, although such embodiments are not intended to be exclusive.

In a special embodiment, the inventive heat-sensitive recording material is designed as a label with a (self-)adhesive layer on the back. As needed, the adhesive layer can be covered by a release material such as a silicone-containing release paper, or the outer protective layer of the inventive recording material can be provided with an additional release layer, which is preferably printed on—ideally by flexograpy. The release layer has a parting agent based on silicone oil and/or silicone grease. By forming the release layer with silicone oil and/or silicone grease, the proposed recording material with a self-adhesive layer on the back can be wound up into a roll without release paper, so that the self-adhesive layer and the release layer come in contact with each other in the roll without sticking to each other permanently.

In an especially preferred embodiment, the release layer can be cured and/or crosslinked under the influence of high-energy radiation such as UV rays or electron beam radiation. Insofar as the release layer is to be cured by UV rays, the monomers or prepolymers used to produce this layer must contain photoinitiators as additives in the known manner. By means of electron beam curing, it has been possible to achieve a release layer which is especially uniform, that is, cured uniformly over its cross section.

The values provided in the specification and in the claims for the basis weight, the percentage by weight (wt. %), and the parts by weight are based in each case on the "absolute dry" weight, that is, absolutely dry parts by weight. In the discussions concerning the hollow pigment particles of the masking layer, the numerical data provided in this regard are calculated on the basis of the "air-dried" weight, that is, air-dried parts by weight, minus the parts by weight of water around and in the interior of the pigments in their as-delivered form.

The invention is now to be explained in greater detail on the basis of the following examples.

EXAMPLE 1

On a long-wire paper machine, a paper web, as substrate, consisting of bleached and ground hardwood and softwood pulps with a basis weight of 67 g/m$^2$, was produced with the use of the conventional additives in the conventional amounts. A doctor blade was used to apply an 8 g/m$^2$ intermediate layer consisting of a mostly calcined kaolin as pigment, styrene-butadiene latex as binder, and starch as cobinder; this intermediate layer was then dried. So that the intermediate layer would function as an emission layer in accordance with the present invention, the intermediate layer also contained dyes which are fluorescent under UV light in the form of optical brighteners in an amount of 2 wt. % (absolute dry), based on the total weight of the intermediate layer (absolute dry). By the use of a revolving doctor, a masking layer containing 16.67 wt. % (absolute dry) of binder and 83.33 wt. % of hollow pigment particles was applied to the intermediate layer and dried. The percentages here are based on the total weight (absolute dry) of the finished masking layer, which had a basis weight of 2.5 g/m$^2$. The finished paper produced in the manner described was then sent through a thermal printer. The hollow pigment particles of the masking layer were partially fused by the printhead of the thermal printer in accordance with a predetermined grid pattern, so that areas in the masking layer with fused hollow pigment particles and areas with unfused hollow pigment particles were created. Under daylight, the paper coated with the emission layer and the masking layer appeared uniformly white. Under UV light, strong fluorescence could be seen from the areas of the masking layer in which the hollow pigment particles had been fused to each other by the influence of heat from the printhead of the thermal printer. The fluorescence originated from the fluorescent components of the intermediate layer, the emitted light beams of which could be seen through the transparent areas of the masking layer where the hollow pigment particles had been fused.

EXAMPLE 2

The paper already used in Example 1 with a substrate, with an intermediate layer designed as an emission layer, and with the masking layer applied on top of the intermediate layer, was provided with a heat-sensitive printing layer with a basis weight of 4 g/m$^2$, which was applied over the entire surface of the masking layer. The heat-sensitive printing layer contained 13.89 wt. % of binder, 27.78 wt. % of dye acceptor, and 58.33 wt. % of encapsulated dye precursor. The method described in DE 198 54 866 A1 was used for the encapsulation. Flexographic printing was used to apply a UV-cured protective layer of 2 g/m$^2$ to the heat-sensitive printing layer. The finished heat-sensitive recording material thus produced was sent to a thermal printer. The hollow pigment particles of the masking layer were partially fused by the printhead of the thermal printer at a temperature $T_1$ of 101° C. to form a predetermined stripe pattern, so that areas in the masking layer with fused hollow pigment particles and areas with unfused hollow pigment particles were created. By the use of a temperature $T_2$ of 145° C., a predetermined pattern of lettering was produced in the heat-sensitive printing layer by the printhead of the thermal printer. Under daylight, the heat-sensitive printing paper appeared uniformly white with fully formed lettering. Under UV light, strong fluorescence could be seen in the areas of the masking layer in which the hollow pigment particles had been fused together by the heat of the printhead of the thermal printer. The fluorescence originated from the fluorescent components of the intermediate layer, whose emitted light beams could be seen through the transparent areas of the masking layer where the hollow pigment particles had been fused together.

What is claimed is:

1. A security feature in the form of a luminescent mark for incorporation into a recording material, the security feature comprising:

an emission layer with luminescent components; and a masking layer with a plurality of hollow pigment particles, said masking layer at least partially covering the emission layer, wherein a portion of the plurality of hollow pigment particles of the masking layer are fused by a locally defined heat treatment in an area forming a mark, the area of the mark being transparent so that the emission layer is visible through the area of the mark.

2. The security feature according to claim 1, wherein the luminescent components of the emission layer are fluorescent under UV light.

3. The security feature according to claim 1, wherein the hollow pigment particles of the masking layer are in the form of cup-shaped pigment particles.

4. The security feature according to claim 1, wherein the emission layer and the masking layer are the same color.

5. The security feature according to claim 1, wherein the emission layer with the luminescent components is a substrate for the recording material.

6. The security feature according to claim 1, wherein the masking layer is coated by a protective layer.

7. A heat-sensitive recording material with a security feature in the form of a luminescent mark, the security feature comprising:

an emission layer with luminescent components; and a masking layer with a plurality of hollow pigment particles at least partially covering the emission layer, wherein a portion of the plurality of hollow pigment particles of the masking layer are fused by a locally defined heat treatment in an area forming a mark, the area of the mark being transparent so that the emission layer is visible through the area of the mark.

8. The heat-sensitive recording material according to claim 7, wherein the luminescent components of the emission layer are fluorescent under UV light.

9. The heat-sensitive recording material according to claim 7, wherein the recording material has a substrate, which is the emission layer with the luminescent components.

10. The heat-sensitive recording material according to claim 7, wherein the recording material has a heat-sensitive printing layer, which is applied in the form of a locally defined spot to the masking layer.

11. The heat-sensitive recording material according to claim 7, wherein the recording material has at least a substrate;

a heat-sensitive printing layer;

an intermediate layer, which is situated between the substrate and the heat-sensitive printing layer on a first side of said substrate, the intermediate layer being the emission layer with the luminescent components; and the masking layer with the hollow pigment particles.

12. The heat-sensitive recording material according to claim 11, wherein the intermediate layer contains at least one inorganic pigment selected from the group consisting of natural kaolin, calcined kaolin, silicon oxide, bentonite, calcium carbonate, aluminum oxide, and boehmite.

13. The heat-sensitive recording material according to claim 11, wherein the masking layer at least partially covers the heat-sensitive printing layer.

14. The heat-sensitive recording material according to claim 11, wherein the masking layer is situated between the heat-sensitive printing layer and the intermediate layer.

15. The heat-sensitive recording material according to claim 14, wherein the heat-sensitive printing layer is applied to the masking layer in the form of a locally defined spot.

16. The heat-sensitive recording material according to claim 11, wherein the recording material has at least one protective layer, which is applied on the first side of the substrate which carries the heat-sensitive printing layer, the protective layer being the layer of the recording material that is farthest away from the substrate.

17. The heat-sensitive recording material according to claim 7, wherein the recording material has a heat-sensitive printing layer, which contains at least one dye precursor and at least one dye acceptor, wherein the dye precursor and the dye acceptor react with each other under the effect of heat to form a color and wherein at least one of the dye precursor or the dye acceptor are microencapsulated.

18. A security feature in the form of a luminescent mark for incorporation into a recording material, the security feature comprising:

an emission layer with luminescent components; and a masking layer at least partially covering the emission layer comprising unfused hollow pigment particles, wherein the unfused hollow pigment particles of the masking layer are configured to be transparent when fused by a locally defined heat treatment whereby the emission layer is visible therethrough, wherein the masking layer further comprises fused hollow pigment particles fused by a locally defined heat treatment in an area forming a mark, the area of the mark being transparent so that the emission layer is visible through the area of the mark.

* * * * *